US007014576B1

(12) United States Patent
Posey

(10) Patent No.: US 7,014,576 B1
(45) Date of Patent: Mar. 21, 2006

(54) GOLFING AIDE SYSTEM

(76) Inventor: John Posey, 140 Oak Lake Dr., Spring Hill, FL (US) 34608-6803

( * ) Notice: Subject to any disclaimer, the term of this patent is extended or adjusted under 35 U.S.C. 154(b) by 744 days.

(21) Appl. No.: 09/767,742

(22) Filed: Jan. 23, 2001

(51) Int. Cl.
*A63B 57/00* (2006.01)

(52) U.S. Cl. ..... 473/407

(58) Field of Classification Search ..... 473/406–407, 473/131; 702/149, 158; 342/357.01, 357.12; 701/201
See application file for complete search history.

(56) References Cited

U.S. PATENT DOCUMENTS 5,364,093 A * 11/1994 Huston et al. ..... 273/32 R
5,772,534 A * 6/1998 Dudley ..... 473/407
5,810,680 A * 9/1998 Lobb et al. ..... 473/407
6,029,121 A * 2/2000 Stashko ..... 702/158
6,111,541 A * 8/2000 Karmel ..... 342/357.13
6,230,081 B1 * 5/2001 Albertshofer ..... 701/1
6,236,360 B1 * 5/2001 Rudow et al. ..... 342/357.13
6,236,940 B1 * 5/2001 Rudow et al. ..... 701/300
6,263,276 B1 * 7/2001 Yokoyama et al. ..... 701/207
6,301,545 B1 * 10/2001 Brodie ..... 701/213
6,324,473 B1 * 11/2001 Eschenbach ..... 701/215
6,353,743 B1 * 3/2002 Karmel ..... 455/456
6,424,910 B1 * 7/2002 Ohler et al. ..... 701/202
6,456,938 B1 * 9/2002 Barnard ..... 701/213
6,697,820 B1 * 2/2004 Tarlie ..... 707/104.1

* cited by examiner

*Primary Examiner*—Xuan M. Thai
*Assistant Examiner*—Robert Mosser
(74) *Attorney, Agent, or Firm*—Edward P. Dutkiewicz

(57) ABSTRACT

A method and apparatus for assisting golfers and improving their game including a plurality of electronic devices. Such devices include a global positioning system device, cellular technology device, a wireless modem, a low power radio frequency transceiver and cellular digital packet data technology device. A handheld proprietary touch screen personal computer for a golfer is adapted to transmit and receive information with the peripherals. An operating system allows a golfer to interface with the computer. Software performs the necessary operations based upon the input and output of the personal computer.

1 Claim, 2 Drawing Sheets

GOLFING AIDE SYSTEM

BACKGROUND OF THE INVENTION

1. Field of the Invention

The present invention relates to a golfing aide system and more particularly pertains to assisting golfers and improving their game.

2. Description of the Prior Art

The use of golfing aides of known designs and configurations is known in the prior art. More specifically, golfing aides of known designs and configurations previously devised and utilized for the purpose of assisting golfers through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,438,518 to Bianco et al discloses a player positioning and distance finding system. U.S. Pat. No. 5,685,786 to Dudley discloses a passive golf information system and method. U.S. Pat. No. 5,810,680 to Lobb et al discloses a computer aided game apparatus. U.S. Pat. No. 5,873,797 to Garn discloses a remote golf ball locator. Lastly, U.S. Pat. No. 6,024,655 to Coffee discloses a map-matching golf navigation system.

While these devices fulfill their respective, particular objectives and requirements, the aforementioned patents do not describe a golfing aide that allows for assisting golfers and improving their game.

In this respect, the golfing aide system according to the present invention substantially departs from the conventional concepts and designs of the prior art, and in doing so provides an apparatus primarily developed for the purpose of assisting golfers and improving their game.

Therefore, it can be appreciated that there exists a continuing need for a new and improved golfing aide system which can be used for assisting golfers and improving their game. In this regard, the present invention substantially fulfills this need.

SUMMARY OF THE INVENTION

In view of the foregoing disadvantages inherent in the known types of golfing aides of known designs and configurations now present in the prior art, the present invention provides an improved golfing aide system. As such, the general purpose of the present invention, which will be described subsequently in greater detail, is to provide a new and improved golfing aide system and method which has all the advantages of the prior art and none of the disadvantages.

To attain this, the present invention essentially comprises a method of assisting golfers and improving their game including the steps of providing a global positioning system device that is capable of pinpointing the accurate positions of key landmarks on the golf course. The global positioning system device is adapted to transmit and receive information and to map a landscape of a golf course. Secondly, the method provides a cellular technology device providing standard and advanced mobile phone communication capabilities to golfers. The cellular technology device is adapted to transmit and receive information. Thirdly, the method provides a wireless modem that is able to link the system to a phone line and provide for data communication. The wireless modem is adapted to transmit and receive information. Fourthly, the method provides a low power radio frequency transceiver allowing functional communication between golfers, the clubhouse and any other entity requiring this type of communication. The low power radio frequency transceiver is adapted to transmit and receive information. Next, the method provides a cellular digital packet data technology device that allows for the fast and cost effective transmission of data as required for internet access, email and the like. The cellular digital packet data technology device is also adapted to transmit and receive information. The method further provides a handheld proprietary touch screen personal computer for a golfer. The method also includes transmitting and receiving information between the personal computer and the global positioning system device, the cellular technology device, the wireless modem, the low power radio frequency transceiver and the cellular digital packet data technology device. The method further provides an operating system to allow a golfer to interface with the computer. The method provides software to perform the necessary operations based upon the input and output of the personal computer to enable the system to work and assist the golfer for automated distance calculations, equipment indication, club selection, course management, scoring, statistics, cataloguing courses, mapping of a landscape of a golf course and other functions in a synchronous and beneficial fashion for improved golfing performance. The method includes activating the system to begin collecting latitude and longitude coordinates from a global positioning system at a rate of no less than one coordinate per second. The method includes tracing the perimeter of the desired region such as a tee box, bunker, sand trap, green and fairway with the global positioning system collecting all the points associated with the outline of that region. The method further includes ending the data collection by the manual disabling of the data collection. The method includes importing a unique field into the electronically traced region. The field is representative of the region being traced. The method includes forming a graphic representation of the newly traced region with the appropriate field displayed in the associated region with different representation for each associated region. Finally, the method includes collecting a response from a golfer as to whether there is another region needed to be collected, if "Yes" return to activating step, if "No" end.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golfing aide system which has all of the advantages of the prior art golfing aides of known designs and configurations and none of the disadvantages.

It is another object of the present invention to provide a new and improved golfing aide system which may be easily and efficiently manufactured and marketed.

It is a further object of the present invention to provide a new and improved golfing aide system which is of durable and reliable constructions.

An even further object of the present invention is to provide a new and improved golfing aide system which is susceptible of a low cost of manufacture with regard to both materials and labor, and which accordingly is then susceptible of low prices of sale to the consuming public, thereby making such golfing aide system economically available to the buying public.

Even still another object of the present invention is to provide a golfing aide system for assisting golfers and improving their game.

Lastly, it is an object of the present invention to provide a new and improved method and apparatus for assisting golfers and improving their game comprising a plurality of electronic devices selected from the class of electronic devices including a global positioning system device, cellular technology device, a wireless modem, a low power radio frequency transceiver, and cellular digital packet data technology device. All these devices are adapted to transmit and receive information. A handheld proprietary touch screen personal computer for a golfer is adapted to transmit and receive information with the global positioning system device, the cellular technology device, the wireless modem, the low power radio frequency transceiver and the cellular digital packet data technology device. An operating system allows a golfer to interface with the computer. Software performs the necessary operations based upon the input and output of the personal computer to enable the system to work and assist the golfer for associated functions such as automated distance calculations, equipment indication, club selection, course management, scoring, statistics, cataloguing courses, golf course mapping and other functions in a synchronous and beneficial fashion for improved golfing performance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
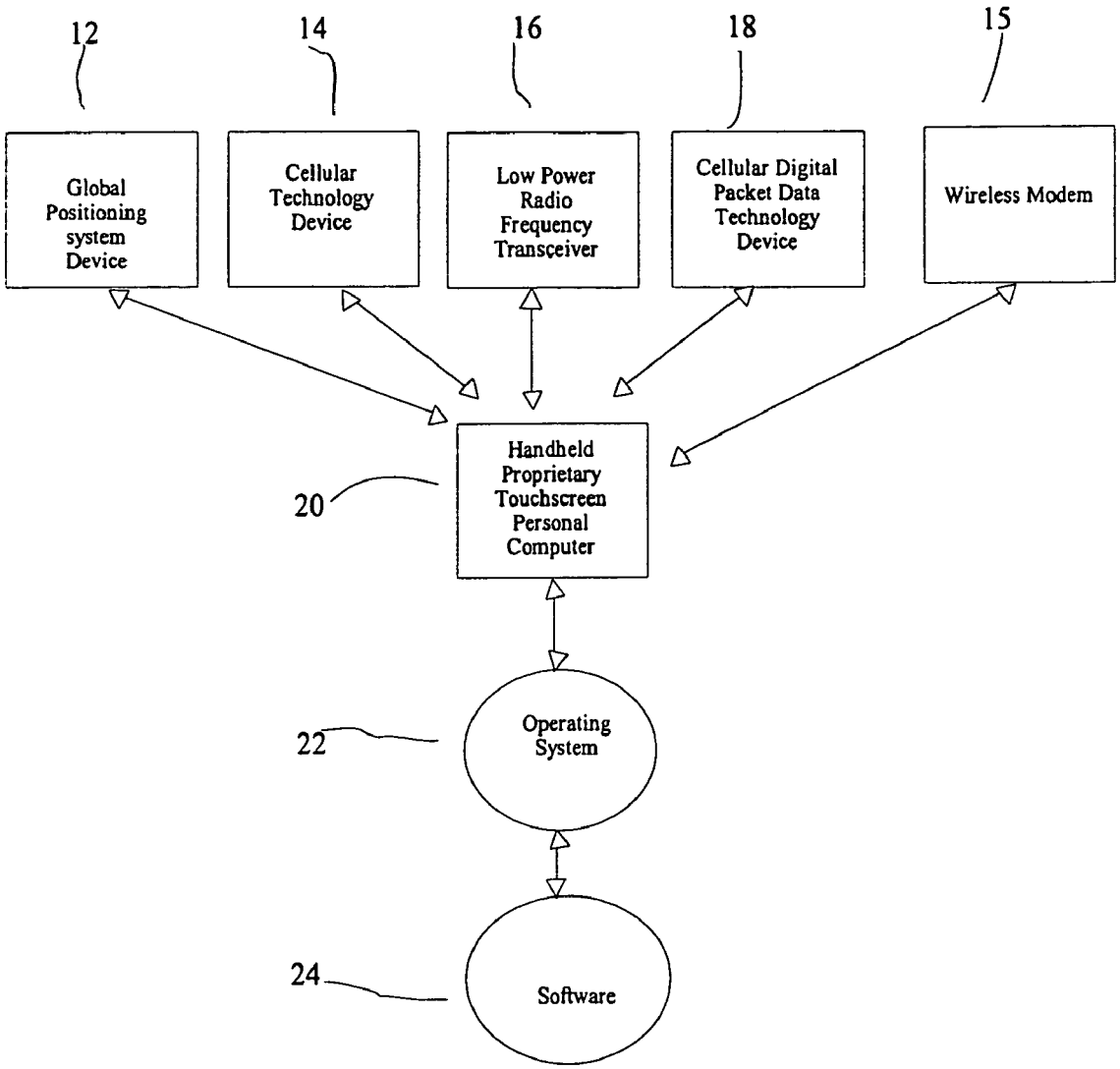
FIG. 1 is a block diagram of the components of the present invention.
Figure 2:
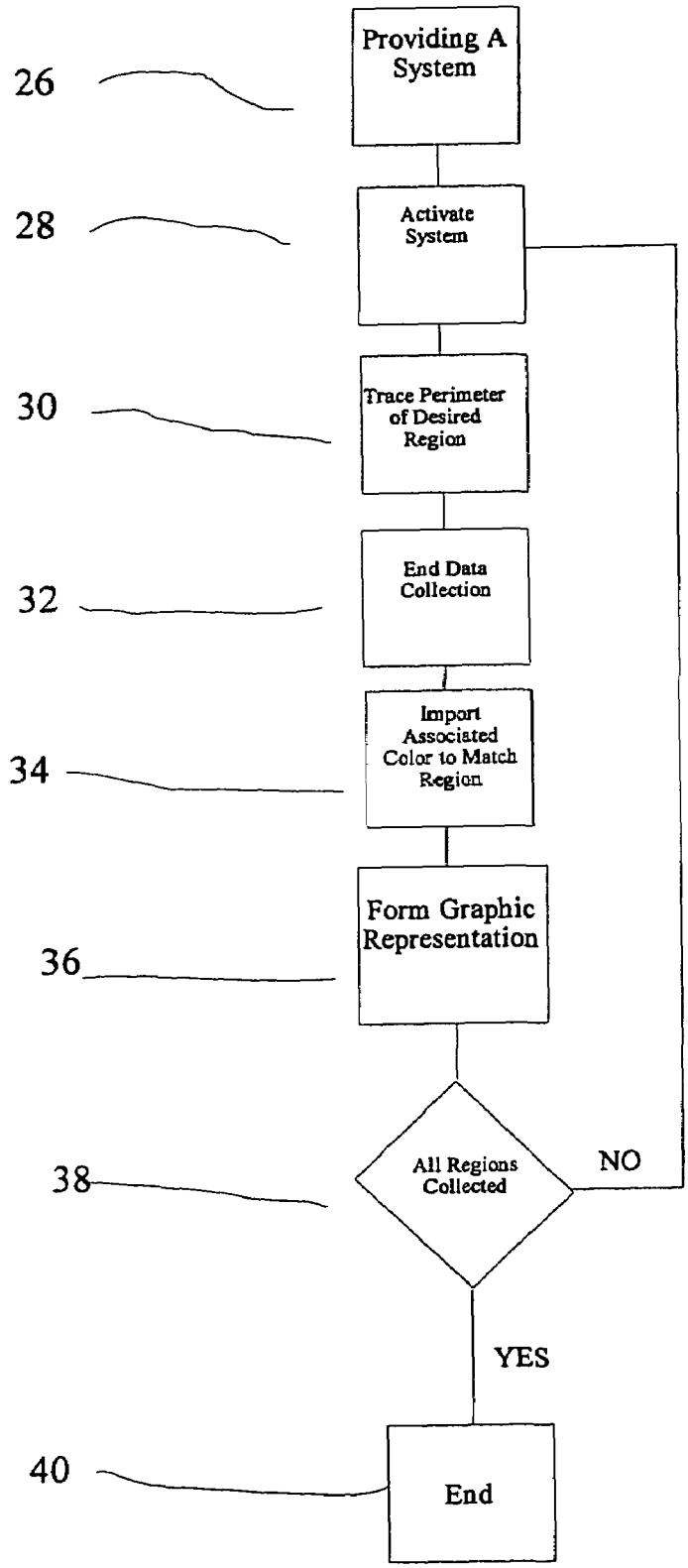
FIG. 2 is a block diagram of the method of the present invention.

With reference now to the drawings, and in particular to FIG. 1 thereof, the preferred embodiment of the new and improved golfing aide system embodying the principles and concepts of the present invention and generally designated by the reference numeral 10 will be described.

The present invention, the golfing aide system 10 is comprised of a plurality of components. Such components are individually configured and correlated with respect to each other so as to attain the desired objective.

The system includes a global positioning system device 12. The global positioning system device is capable of pinpointing the accurate positions of key landmarks on the golf course for mapping of a landscape of a golf course. The global positioning system device is further adapted to transmit and receive information this information. The global positioning system provides latitude and longitude information to the system as well as elevational information.

The system also includes a cellular technology device 14. The cellular technology device provides standard and advanced mobile phone communication capabilities to golfers. The cellular technology device is adapted to transmit and receive information.

The system further includes a wireless modem 15. The wireless modem is able to link the system to a phone line and provide for data communication. The wireless modem is further adapted to transmit and receive information.

The system includes a low power radio frequency transceiver 16. The radio frequency transceiver allows functional communication between golfers, the clubhouse and any other entity requiring this type of communication. The low power radio frequency transceiver is further adapted to transmit and receive information.

The system includes a cellular digital packet data technology device 18. The cellular digital packet data technology device allows for the fast and cost effective transmission of data as required for internet access, email and the like. The cellular digital packet data technology device is adapted to transmit and receive information.

The system includes a handheld proprietary touch screen personal computer 20 for a golfer adapted to transmit and receive information between the personal computer and the global positioning system device, the cellular technology device, the wireless modem, the low power radio frequency transceiver and the cellular digital packet data technology device.

The system also includes an operating system 22. The operating system allows a golfer to interface with the computer. The operating system also allows the user to select from the various operations the system is capable of performing.

The system finally includes software 24. This software performs the necessary operations based upon the input and output of the personal computer to enable the system to work and assist the golfer. Some operations this software can perform include automated distance calculations, equipment indication, club selection, course management, scoring, statistics, cataloguing courses, mapping of a landscape of a golf course and other functions in a synchronous and beneficial fashion for improved golfing performance.

The system further includes a method of assisting golfers by mapping a landscape of a golf course comprising of multiple steps as listed below.

The method provides a system 26 having a global positioning system, personal computer, operating system and software.

The method includes a step that activates the system 28 to begin collect latitude and longitude coordinates from a global positioning system at a rate of no less than one coordinate per second.

Next, the method traces the perimeter 30 of the desired region such as a tee box, bunker, sand trap, green and fairway while the global positioning system collects all the points associated with the outline of that region.

The method ends the data collection 32 by the manual disabling of the data collection. This termination of data collection can also be done automatically. One alternative method of termination is by the system recognizing that the golfer has returned to the origin.

The method includes a step that imports a unique field 34 into the electronically traced region. The field that is inserted is representative of the region being traced. This field comes from the class of fields including colors, textures, designs and photo images which are loaded or taken from a data base of the computer.

The method further includes forming a graphic representation 36 of the newly traced region with the appropriate field displayed in the associated region with different representation for each associated region.

The method then collects a response 38 from a golfer as to whether there is another region that needs to be collected, if "Yes" return to activating step, if "No" end 40.

A person, preferably the golfer, holding a unit of the present invention will walk or ride around a specific feature of a hold on a golf course i.e. a tee box, bunker, fairway, putting green, etc. As the person moves around the feature, the software will read latitude/longitude position from the integrated global positioning system receiver. This reading will be taken at least once every second. As the person concludes the movement by returning to the starting point, the collection of the latitude/longitude points will define to immediately draw a tee box onto the screen. Similarly, walking or riding along a cart path, tree, bunker, green or any other course feature will cause that feature to be drawn to the screen. By this process, any golf course may be dynamically mapped. Realism through use of photo technology is accomplished by using portions of photo images of golf course features, stored in the computer's data base, to fill the outlines of the data points drawn to screen.

The present invention will encompass a handheld PC with the following chip sets on board: global positioning system, cellular, low power RF transceiver, cellular digital packet data, wireless modem. Primarily these chip sets will be utilized to perform various functions for the golfer or golfing industry, as well as ancillary functions commensurate with standard Microsoft supported functions, such as internet access, word processing, spreadsheets, personal data, etc. Many non-golf related solutions can be provided due to the flexible, and powerful positron reporting, and communication facilities built into the unit.

Utilizing the Microsoft Window CE operating system, supporting the present inventions application software, the following on board modules will perform associated functions.

Global Positioning System

The present invention software will continuously poll the global positioning system receiver, and apply proprietary algorithms to determine the absolute position of the device on the surface of the earth. This position information is so precise as to deliver the accuracy required by a professional, or non professional golfer, in the determination of club selection and strategy, in playing any given shot. Additional functionality will be for the golfer, through the map generating feature of the present inventions software, to survey and automatically draw the course of his choice. This feature will allow for almost immediate play on any course in the world, eliminating the need for pre-surveyed course data. Ancillary functionality will be general geographic mapping, such that driving instructions, or position location of any given destination will be available.

Cellular

Cellular technology will give standard, and advanced mobile phone communication capability to the golfer.

Low Power RF Transceiver

This feature will allow private, functional communication between the golfer/device and the clubhouse, or any other entity requiring that type of communication. Functionality for the golf industry would be the ability of the golf course to dynamically update the device with current pin position, wind condition, or other pertinent course information. Additionally, the golf course would use this feature to determine location and speed of play of the golfer, as well as to present advertising, or receive food and beverage orders from the player.

Cellular Digital Packet Data

This technology will allow for the fast, and cost effective transmission of data as required for Internet access, email, etc.

Wireless Modem

The modem will be the link to phone line, data communications.

Though the present invention software was developed primarily for the golfing industry, additional features will be built in to allow such things as:

If the device is lost, communications can be established and the device could supply its specific geographical location.

Parents could locate the position of their children and communicate with them easily.

The location of employees, or vehicles, or property, could be easily established.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of assisting golfers and improving their game comprising the steps of:

providing a global positioning system device which is capable of locating positions of any one of a plurality of landmarks on a golf course, the global positioning system device capable of electronically transmitting and receiving information with the device also capable of constructing a map of a landscape of a golf course;

providing a cellular technology device for providing mobile phone communication capabilities to golfers, the cellular technology device being able to transmit and receive information;

providing a wireless modem being able to link a communications system to a phone line and provide for data communication, the wireless modem being able to transmit and receive information;

providing a low power radio frequency transceiver for allowing functional communication between golfers and a clubhouse, the low power radio frequency transceiver being able to transmit and receive information;

providing a cellular digital packet data technology device allowing for fast transmission of data as required for internet computer access and email, the cellular digital packet data technology device being able to transmit and receive information;

providing a handheld touch screen personal computer for a golfer;

transmitting and receiving information between the personal computer and a global positioning system device, a cellular technology device, a wireless modem, a low power radio frequency transceiver and a cellular digital packet data technology device;

providing an operating system to allow a golfer to interface with a computer;

providing software to perform programmed operations based upon the input and output of a personal computer to assist the golfer by providing automated distance calculations, equipment indication, club selection, course management, scoring, statistics, and cataloguing courses in synchronous fashion for improved golfing performance;

activating the system to begin collecting latitude and longitude coordinates from a global positioning system at a rate of no less than one coordinate per second;

tracing a perimeter of a desired region with the global positioning system collecting all points associated with an outline of that region to enable the computer to construct a map of the region;

ending the data collection by the manual disabling of the data collection;

importing a unique field into an electronically traced region, the field being representative of the region being traced;

forming a graphic representation of a newly traced region with an appropriate field displayed in an associated region with different representation for each associated region;

and collecting a response from a golfer as to whether there is another region needed to be collected if "Yes" returning to the activating step, if "NO" end.

* * * * *